United States Patent [19]

Buechel et al.

[11] Patent Number: 4,867,365

[45] Date of Patent: Sep. 19, 1989

[54] EXPLOSIVE POWDER CHARGE OPERATED FASTENING ELEMENT SETTING DEVICE

[75] Inventors: Franz Buechel, Ruggell; Klemens Frick, Balzers, both of Liechtenstein

[73] Assignee: Hilti Aktiengesellschaft, Fürstentum, Liechtenstein

[21] Appl. No.: 220,483

[22] Filed: Dec. 14, 1987

[30] Foreign Application Priority Data

Dec. 13, 1986 [DE] Fed. Rep. of Germany ..... 3642606

[51] Int. Cl.[4] ..... B25C 1/14; B25C 1/18

[52] U.S. Cl. ..... 227/10; 227/9

[58] Field of Search ..... 227/8, 9, 10, 11

[56] References Cited

U.S. PATENT DOCUMENTS

| | | | |
|---|---|---|---|
| 4,025,029 | 5/1977 | Kotas et al. | 227/10 |
| 4,252,259 | 2/1981 | Brosius | 227/10 X |
| 4,492,329 | 1/1985 | Benson et al. | 227/10 |
| 4,577,793 | 3/1986 | Jochum | 227/10 |

*Primary Examiner*—Paul A. Bell

*Attorney, Agent, or Firm*—Toren, McGeady & Associates

[57] ABSTRACT

An explosive powder charge operated fastening element setting device includes a housing having a firing direction with a guidance tube located within an outlet tube in the housing. The guidance tube and outlet tube are displaceable in the firing direction within the housing. A piston for driving a fastening element is displaceable in the firing direction within the guidance tube so that it can be returned to the firing position. A spring clip mounted in the outlet tube transmits a pulling motion on the outlet tube to the guidance tube while the piston is held in the housing against similar movement. During the pulling motion, a spring clip with a pair of legs extending transversely of the firing direction coacts with shoulders projecting outwardly from the guidance tube at its forward end for placing the piston in the firing position toward the rearward end of the guidance tube.

9 Claims, 1 Drawing Sheet

III
II
H
L

EXPLOSIVE POWDER CHARGE OPERATED FASTENING ELEMENT SETTING DEVICE

BACKGROUND OF THE INVENTION

The present invention is directed to an explosive charge operated fastening element setting device with a guidance tube containing a driving piston axially displaceably mounted within a housing. An outlet tube axially guided in the housing is displaceable co-axially with the guidance tube. The outlet tube extends from the housing and partially overlaps the guidance tube within the housing. A U-shaped spring clip is positioned in the outlet tube with legs extending through grooves in the tube with the grooves located diametrically opposite one another and extending transversely of the firing direction of the device. The legs are arranged in axial alignment with shoulders extending radially from the forward end of the guidance tube.

An explosive powder charge operated fastening element setting device is disclosed in a Hilti prospectus at page 4.78. In this device, after driving a fastening element, a guidance tube for the driving piston is displaced in a housing in the firing direction for returning the piston into the firing position. The displacement of the guidance tube is effected by moving an outlet tube in the firing direction with the outlet tube coupled to the guidance tube so that it is displaceable to a limited extent. A U-shaped spring clip supported in the outlet tube serves as the coupling member and it has legs extending through grooves into the bore of the outlet tube and the legs co-act with protuberances on the guidance tube located at its forward end. The spring clip legs are formed of strip-shaped spring steel, and are regained in position due to their elastic or flexural properties.

When the outlet tube is moved in the firing direction, the forward sides of the legs directed in the firing direction abut in a blow-like manner against the protuberances on the guidance tube. As a result, high specific compressive loads are developed which lead to the deformation of the spring clip and of the protuberances, impairing the function and useful life of these parts. An additional disadvantage is that the gas pressures developed during the firing operation in the device act radially outwardly on the legs and, after a relatively brief period of operation, reduce the spring action so that the legs can no longer fulfill the coupling action in a reliable manner.

SUMMARY OF THE INVENTION

Therefore, it is the primary object of the present invention, to provide a fastening element setting device of the above described type with spring clips affording the coupling action of the outlet tube with the guidance tube so that high impact forces can be developed without damage and without any impairment due to the action of the explosive gases developed within the device when a fastening element is driven into a receiving material.

In accordance with the present invention, the legs of the spring clip are formed as circular-segment shaped members radially abutting the inside surface of the housing. Further, the legs have surfaces facing in the firing direction corresponding essentially to the sum of the corresponding surfaces of the grooves and at least a portion of the corresponding surfaces of the protuberances or shoulders on the guidance tube.

The spring clip legs formed as circular-segment shaped members are maintained opposite one another by a bridge or bight member formed of strip-shaped spring steel so that the legs are pressed against the inside surface of the housing by the resulting spring force. Accordingly, the legs cannot be displaced radially outwardly by the explosive gases developed in the device into a position where they are unable to function. The face of the legs directed in the firing direction form a stop or abutment surface projecting into axial alignment with the shoulders on the guidance tube. These stop surfaces are by a multiple greater than the corresponding stop surfaces of the known legs. As a result, lower pressures are developed which do not tend to damage any parts of the device.

Preferably the spring clip has a circularly-shaped outer contour. In this way, the spring clip rests around its entire circumferential surface at the inside surface of the housing which affords a protective support.

The maximum height of each leg is preferably 0.1 to 0.3 times the outside diameter of the spring clip. Further, the dimension of the legs in the firing direction is preferably 0.1 to 0.3 times the outside diameter of the spring clip. This shape of the spring clip affords a sufficiently large abutment surface for the shoulder without the grooves receiving the legs having a dimension impairing the stability of the outlet tube and, in addition, an adequate stability of the legs with a relatively small mass is assured.

To attain a long useful life of the legs, the size of the legs facing in the firing direction which contact the shoulders have as an improvement a recessed abutment surface for the shoulders. Accordingly, deformation of the abutment surfaces by the shoulders occurring over a extended period of use does not impair proper operation or interfere with the disassembly of the spring clip, since such deformation occurs offset opposite to the firing direction with respect to the guidance provided by the outside surfaces of the legs. A similar abutment surface can be provided on the oppositely facing surface of the legs permitting a random installation of the spring clip into the grooves in the outlet member due to its symmetrical design or, in other words, either side of the spring clip can be directed toward the shoulders on the guidance tube.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figures 1, 2, 3, 4:
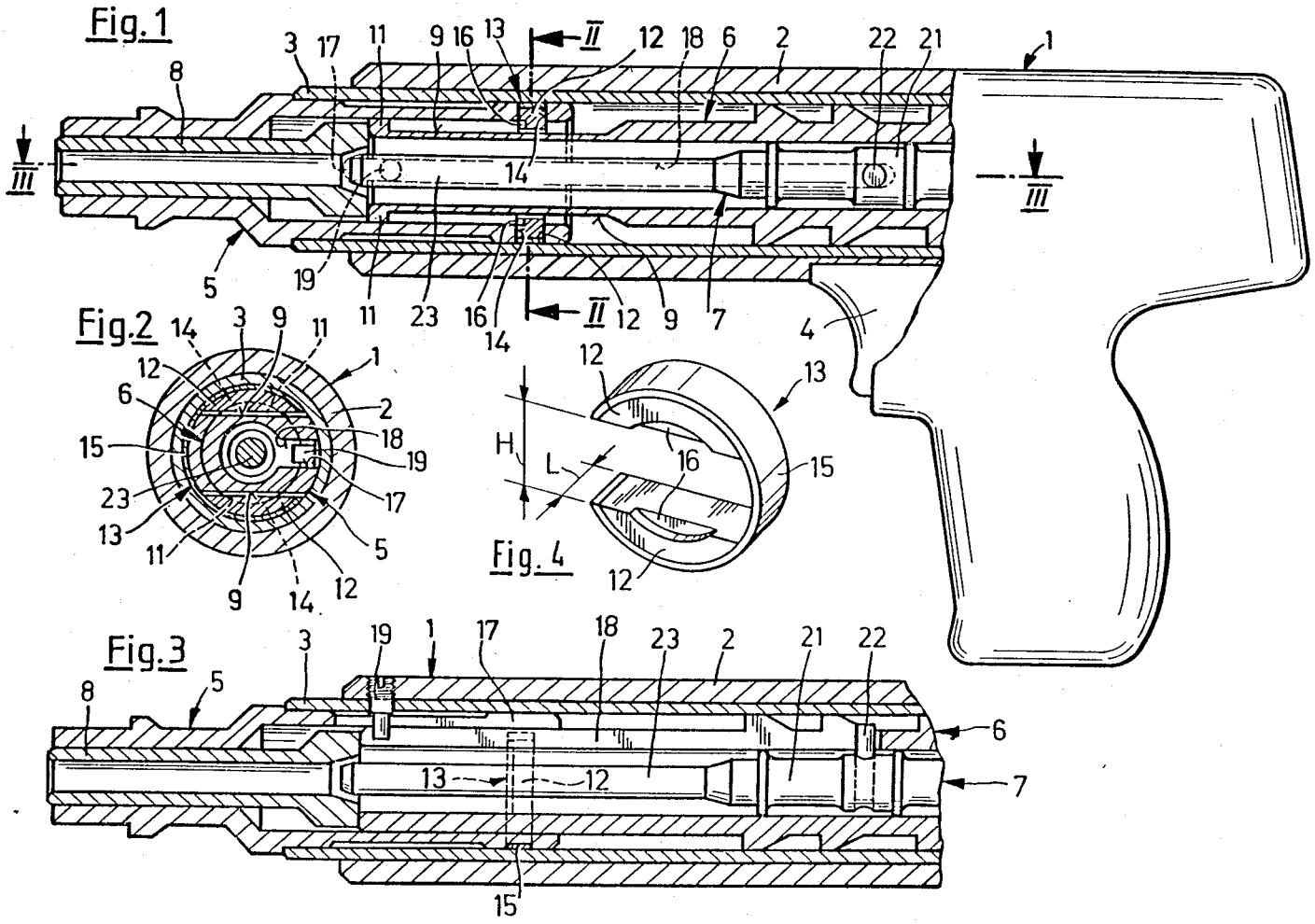
FIG. 1 is a side elevational view, partially in cross-section, of a fastening element setting device embodying the present invention.
FIG. 2 is a sectional view taken along the line II—II in FIG. 1.
FIG. 3 is a partial sectional view of the fastening element setting device illustrated in FIG. 1, and taken along the sectional plane III—III in FIG. 1.
FIG. 4 is a perspective view of the spring clip shown in FIGS. 1 and 2.

In FIG. 1, a fastening element setting device is illustrated in the firing condition, that is ready to drive a fastening element, not shown, out of the device in the firing direction, that is, to the left as viewed in FIG. 1. The parts forming the device have a forward end and a rearward end relative to the firing direction. The device includes a housing 1 formed in the manner of a handgun and including an outer shell 2, and an inner support tube 3. In the rearward part of the housing, there is a handle projecting downwardly with a trigger 4 for initiating the firing operation. Support tube 3 displaceably guides an outlet tube 5 in the firing direction, that is, in the axial direction of the outlet tube. A guidance tube 6 has an axially extending portion from its forward end located within the outlet tube 5 and the guidance tube 6 extends rearwardly within and in sliding engagement with the support tube 3. Outlet tube 5 overlaps the guidance tube 6 in a concentric manner. Guidance tube 6 has an axially extending bore or barrel in which a driving piston 7 is axially displaceably supported. An explosive powder charge, not shown, can be fired, by means of the trigger 4, rearwardly of the piston for driving the piston in the firing direction. Extending rearwardly from its forward end, a tube-shaped fastening element guide 8 is located within the outlet tube 5. The guide 8 is in axial alignment with the piston 7.

As shown best in FIG. 2, guidance tube 6 has axially extending flats or flattened surfaces 9, located diametrically opposite one another on the outside surface of the guidance tube. Shoulders 11, note FIG. 1, project radially outwardly from the flats 9 at the forward end of the guidance tube. The shoulders extend outwardly to the inside surface of the outlet tube 5. A U-shaped spring clip 13, note FIG. 4, has a pair of diametrically opposite legs 12 in the form of circular-segment shaped members and the legs in the assembled position are in axial alignment, but spaced rearwardly from the shoulders 11, note FIG. 1. Grooves 14 extend transversely through the outlet member 5 adjacent the rearward end of the tube. Legs 12 are located in the grooves 14 and abut radially outwardly against the inside surface of the housing 1, or more specifically against the inside surface of the support tube 3. The radially directed abutment of the spring clip 3 formed of the legs 12 and a bridge or bight part 15 is best shown in FIG. 2. The bridge 15 is formed of spring steel. The legs 12 have a forward side and a rearward side with the forward side facing toward the shoulders 11, and the forward side has recessed abutment surfaces 16 for affording impact with the shoulders 11. Note the recessed surfaces 16 shown in FIG. 4. The circular-segment shaped legs have a maximum height H and an axial dimension or dimension in the firing direction L, note FIG. 4. Each of these dimensions corresponds to 0.1 to 0.3 times the outside diameter of the spring clip 13.

As set forth in FIGS. 2 and 3, the outlet tube 5 and the guidance tube 6, each have respective slots 17, 18 extending for a portion of their length, that is, in the firing direction, and located radially opposite the bridge 15. In FIG. 3, a stud 19, is screwed into the forward end region of the housing 1, and extends radially inwardly through the slot 17 with its free end projecting radially inwardly into the slot 18 in the guidance tube 6. At the rearward end of the driving piston 7, the head 21 of the piston has a pin 22 extending transversely of the firing direction guided in the slot 18, and is in alignment in the driving direction with the stud 19, projecting into the slot 18.

When the driving of a fastening element into the receiving material has been completed, the piston 7 is located in a displaced position from that shown in FIGS. 1 and 3, with a shank 23 of the piston extending through the guide 8 and with its head 21 and pin 22 located in the proximity of the stud 19. To return the piston 7 into the firing position, shown in FIGS. 1 and 3, the outlet tube 5 is pulled manually in the firing direction. During the pulling action, the legs 12 abut against the shoulders 11, whereby the guidance tube 6 is also displaced relative to the housing 1 in the firing direction by the outlet tube. As the guide tube is moved in the firing direction, the pin 22 bears against the stud 19 with the piston 7 being held against any comparable movement. Accordingly, the piston 7 relative to the guidance tube 6 is returned to the firing position ready to drive another fastening element. After the pulling action is completed, the outlet tube 5, the guidance tube 6, and the guide 8, are returned opposite to the firing direction into the position shown in FIGS. 1 and 3, ready to drive the next fastening element.

While specific embodiments of the invention have been shown and described in detail to illustrate the application of the inventive principles, it will be understood that the invention may be embodied otherwise without departing from such principles.

We claim:

1. An explosive powder charge fastening element setting device comprises a housing having a forward end and a rearward end with said rearward end to forward end direction defining the firing direction in which fastening elements are driven from the setting device, a guidance tube having an axis extending in the firing direction and being axially displaceably mounted within said housing, a fastening element driving piston axially displaceably mounted in said guidance tube, an outlet tube mounted in the forward end of said housing and projecting into and out of said housing and partially overlapping said guidance tube within said housing, said outlet tube being axially displaceably mounted in said housing and arranged in coaxial relation with said guidance tube, said outlet tube located within said housing having grooves located diametrically opposite one another and extending transversely of the axial direction thereof and located within said housing, a substantially U-shaped spring clip mounted in said outlet tube having a pair of spaced legs and a bight section interconnecting said legs, said legs extend into said grooves in said outlet tube, and said spring clip being displaceable in the axial direction with said outlet tube, said guidance tube having a forward end and a rearward end relative to the driving direction with shoulders projecting transversely of the firing direction outwardly from said guidance tube toward said outlet tube and said shoulders located in alignment in the firing direction with and spaced axially from said spring clip, wherein the improvement comprises that said legs have a circular segment shape transverse to the firing direction with a radially outer surface in abutting contact with an inner surface of said housing, and the surfaces of said legs extending transversely of the firing direction corresponds substantially to the sum of the corresponding surfaces of said grooves and of at least a portion of the corresponding surfaces of said shoulders.

2. An explosive powder charge operated fastening element setting device, as set forth in claim 1, wherein said spring clip has a circularly-shaped radially outside surface.

3. An explosive powder charge operated fastening element setting device, as set forth in claim 2, wherein the maximum height of said legs corresponds to 0.1 to 0.3 times the diameter of the radially outer circumferential surface of said spring clip.

4. An explosive powder charge operated fastening element setting device, as set forth in claim 3, wherein the dimension of said legs of said spring clip in the firing direction corresponds to 0.1 to 0.3 times the diameter of the circumferential outside surface of said spring clip.

5. An explosive powder charge operated fastening element setting device, as set forth in claim 4, wherein said legs facing toward said shoulders have a recessed abutment surface for contacting said shoulders.

6. An explosive powder charge operated fastening element setting device, as set forth in claim 2, wherein the dimension of said legs of said spring clip in the firing direction corresponds to 0.1 to 0.3 times the diameter of the circumferential outside surface of said spring clip.

7. An explosive powder charge operated fastening element setting device, as set forth in claim 1, wherein said legs facing toward said shoulders have a recessed abutment surface for contacting said shoulders.

8. An explosive powder charge operated fastening element setting device, as set forth in claim 1, wherein said guidance tube has diametrically opposite flats extending from said shoulders in the direction opposite to the firing direction for at least part of the axially extending outer surface of said guidance tube.

9. An explosive powder charge operated fastening element setting device, as set forth in claim 1, wherein said bight section of said U-shaped spring clip is strip shaped and is formed of spring steel.

* * * * *